United States Patent [19]

Sheets

[11] 4,050,849

[45] Sept. 27, 1977

[54] HYDRODYNAMIC TRANSMISSION FOR SHIP PROPULSION

[76] Inventor: Herman E. Sheets, 87 Neptune Drive, Groton, Conn. 06340

[21] Appl. No.: 678,392

[22] Filed: Apr. 19, 1976

[51] Int. Cl.[2] ..... B63H 11/04; B63H 23/26

[52] U.S. Cl. ..... 416/171; 416/20 R; 115/34 A; 60/221

[58] Field of Search ..... 416/171, 20 B; 60/221, 60/325, 398; 115/14, 34 R, 34 A

[56] References Cited

U.S. PATENT DOCUMENTS

| | | | |
|---|---|---|---|
| 472,199 | 4/1892 | Seabury | 416/20 B |
| 1,759,511 | 5/1930 | Kort | 115/34 A |
| 1,805,597 | 5/1931 | Pratt | 115/34 A |
| 2,511,156 | 6/1960 | Glass | 416/20 B |
| 3,129,767 | 4/1964 | McLean | 416/20 B |
| 3,285,011 | 11/1966 | Meyerhoff | 60/221 |
| 3,385,374 | 5/1968 | Kaplan et al. | 416/20 B |
| 3,598,080 | 8/1971 | Shields | 115/14 |
| 3,678,689 | 7/1972 | Ishiwata | 60/221 |
| 3,779,199 | 12/1973 | Mayer | 115/14 |

*Primary Examiner*—Everette A. Powell, Jr.
*Attorney, Agent, or Firm*—Thompson, Birch, Gauthier & Samuels

[57] ABSTRACT

The present invention relates to a hydrodynamic transmission for ship propulsion comprising a prime mover driving an axial flow pump in combination with an open, water-powered turbine for driving propeller blades. The power plant and the propeller are not mechanically connected, and power is transmitted through the hydrodynamic transmission. The invention also provides for a thrust-reversing mechanism specially adapted to the hydrodynamic transmission described herein.

11 Claims, 8 Drawing Figures

HYDRODYNAMIC TRANSMISSION FOR SHIP PROPULSION

BACKGROUND OF THE INVENTION

The need for reducing the weight of ships is well known. A major weight component of propeller-driven ships is the reduction gear mechanism. The reduction gear is also associated with high costs of production and maintenance. U.S. Pat. Nos. 1,805,597 and 2,298,869 are directed to ship propulsion systems in which the reduction gear is eliminated and power for the propellers is generally directly by steam-driven turbines. While such systems are suitable for certain applications, they are cumbersome, inefficient and limited by the need for accomodating a steam-driven turbine power source in close proximity to the propeller blades. Furthermore, the propeller speed is directly controlled by the steam turbine thereby adding another source of inefficiency.

OBJECTS OF THE INVENTION

A general object of this invention is to provide a hydrodynamic transmission system for ship propulsion which eliminates the need for a reduction gear mechanism.

Another general object of this invention is to provide a propulsion system which eliminates the reduction gear and is driven by a prime mover remotely located from the propeller blades.

It is a specific object of this invention to provide a propulsion system without a reduction gear comprising a remotely-located prime mover, an axial flow pump, and an "open" turbine which uses seawater as the transmission fluid.

A further specific object is to provide an improved propulsion system having particular application to submarines and high speed surface ships.

Other more specific objects of this invention include the following: (a) eliminating the need for heat exchangers to cool the transmission fluid by using seawater as the fluid in an "open" system; (b) using the turbine discharge for thrust generation; (c) employing a relatively simple thrust reversing mechanism; (d) employing a high speed axial flow pump for small size and small weight of pump, shaft and bearings, and to minimize cavitation; (e) preferably employing a multi-stage axial flow turbine; (f) varying the transmission ratio, i.e. the propeller speed at constant power plant speed, by adjusting the pump guide vanes; (g) reducing the ordinary hull drag forces; and, (h) providing a transmission system which is readily adapted to either an integrated structure with the hydraulic turbine located inside the propeller hub or a structure wherein the propeller and hydraulic turbine unit is a separate, detachable unit.

Further objects and advantages of the present invention will become apparent from the description which follows.

The drawings will be described in greater detail below.

DESCRIPTION OF THE PREFERRED EMBODIMENT

The novel system of this invention for supplying propulsive thrust consists of the following basis components:

1. an existing prime mover, such as a steam turbine supplying the propulsive power;
2. a pump directly driven by the prime mover, preferably at the shaft speed of the prime mover and using seawater as its fluid;
3. a water turbine driven by the pressurized water by the pump;
4. a conventional propeller driven by the water turbine;
5. radial and thrust bearings; and,
6. supporting vanes, the pump and turbine casing, and the thrust reversing mechanism.

Figure 1:
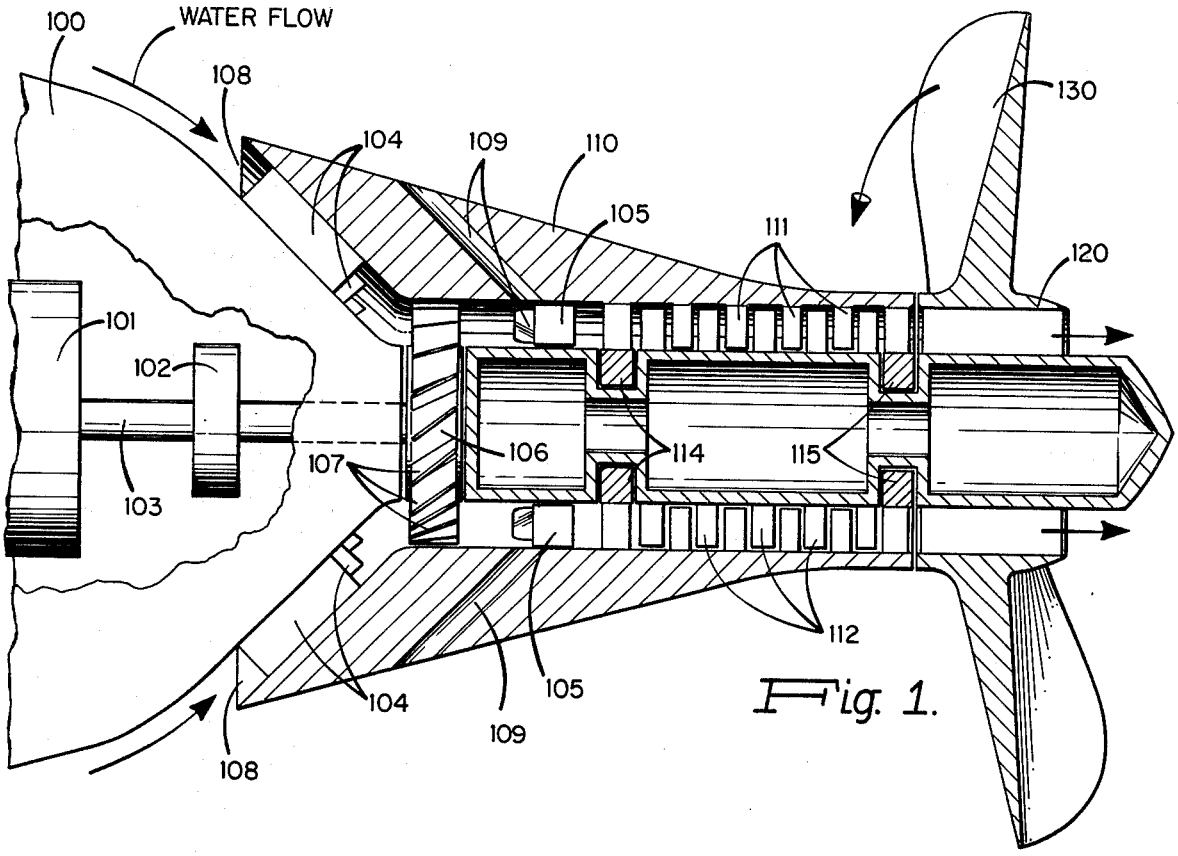
FIG. 1 shows the hydrodynamic transmission system of this invention as part of an integrated unit with the hull of a submarine.
Figure 7:
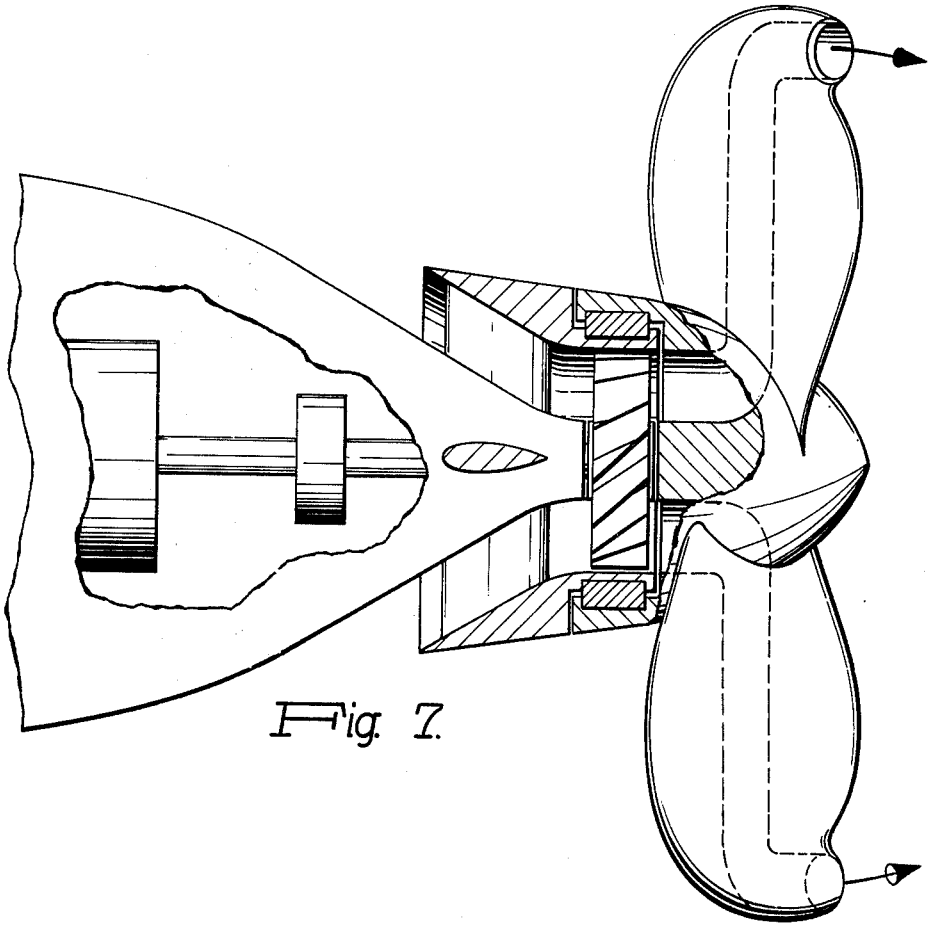
FIG. 7 shows an alternative embodiment of this invention in which an axial flow pump is used to drive a radial turbine.

The basic arrangement of the system is illustrated in FIG. 1. The proposed hydraulic transmission uses seawater as a hydraulic fluid and is of the open type, thus, avoiding recirculation and the associated cooling requirements. Power from the prime mover 101, which is typically a steam turbine but may comprise any convenient power source, is transmitted to axial pump 106 by means of a shaft 103 supported by bearings 102. The pump of the transmission should be essentially of the axial flow type because the high speed of the power turbine (prime mover) requires a high specific speed pump, and an axial flow pump is ideally suited for this application. This axial pump, enclosed in pump and turbine casing 110, in turn drives pump impeller blades 107. Seawater enters the space between pump impeller blades 107 by means of a conical channel 108 which is maintained between the ship's hull 100 and pump and turbine casing 110 by means of a combination of support-guide vanes 104. There are also movable vanes 105 downstream. The seawater driven by axial pump 106 in turn drives a multi-stage axial turbine comprising stationary turbine blades 111 and rotating turbine blades 112. The exact number of stages is not critical and may be varied according to the pressure and flow developed by the pump. The first and last turbine stages also act as supports for the propeller and hub. These two stages are connected to both the propeller hub and to bearings 114 and 115 around the propeller support shaft. The bearings for the device include both rotational bearings and thrust bearings. The turbine, being connected to the propeller hub, forces the propeller 130 to turn as the seawater is forced through the turbine. The propulsive thrust for the ship is provided finally by both the propeller and the exhaust waterjet of the turbine. In the arrangement shown in FIG. 1, the turbine is connected to the propeller hub 120 with the propeller blades connected to hub 120. Although in the preferred embodiment of this invention a multi-stage axial flow turbine as shown in FIG. 1 is employed, for some applications it may be both suitable and desirable to employ either a single stage axial turbine or, as shown in FIG. 7, a centrifugal or radial type of turbine where the turbine exhaust is radially outward through the propeller blades. While less preferred, these alternative embodiments are also intended to be within the scope of this invention. Finally, channel 109 in casing 110 can be used in conjunction with the movable vanes 105 to provide a thrust reversing mechanism as discussed below.

Figure 2:
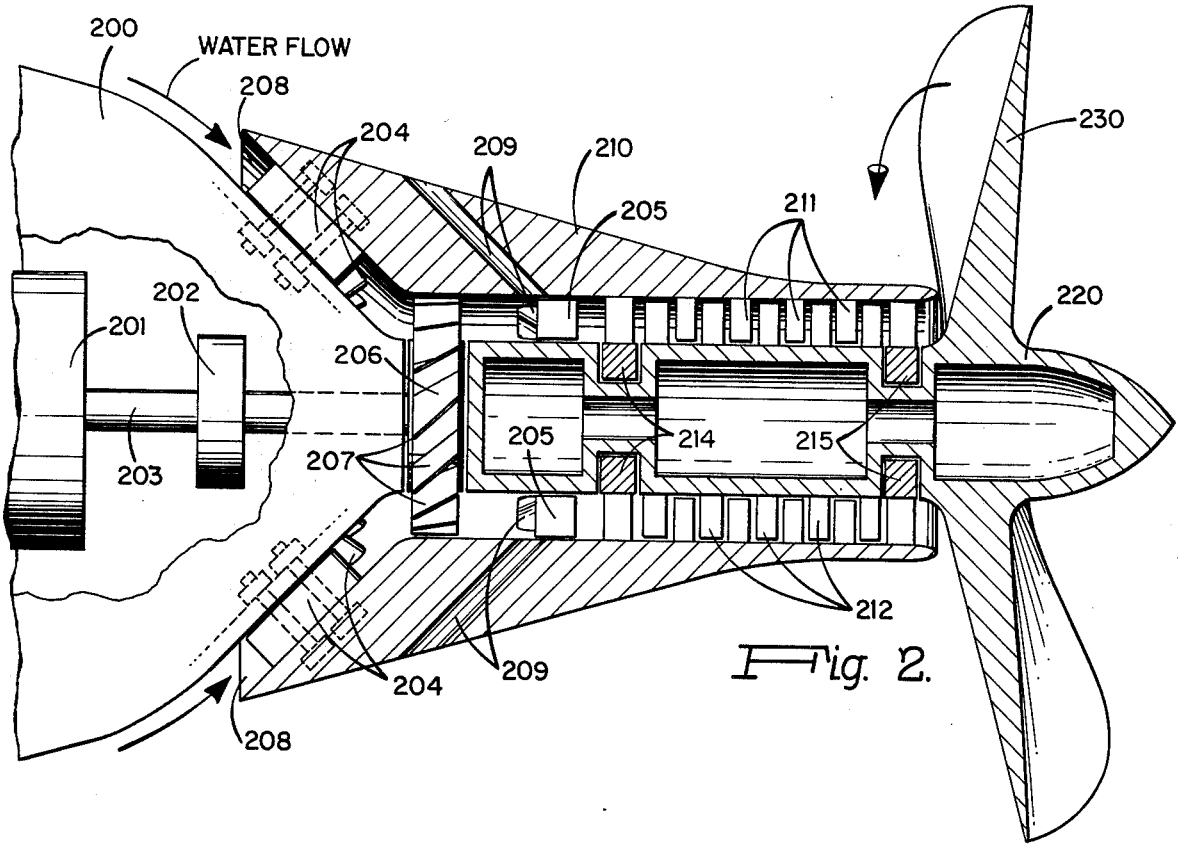
FIG. 2 shows the hydrodynamic transmission system of this invention where the propeller and turbine are embodied in a separate unit which is readily detachable from a submarine hull.

FIG. 2 shows an embodiment of the invention similar to FIG. 1 except that the turbine and propeller assembly are a separate and readily-detachable unit from the hull of the ship. In other respects, this embodiment of the invention operates substantially identically to that shown in FIG. 1 as described above, and the numbering corresponds to that in FIG. 1.

Figure 3:
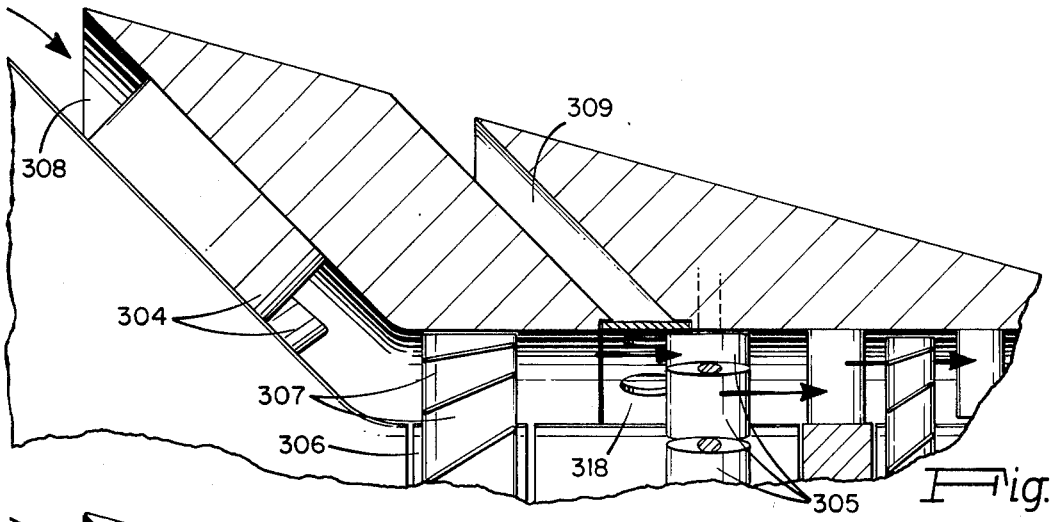
FIGS. 3 and 4 illustrate the thrust reversing mechanism of this invention.
Figure 4:
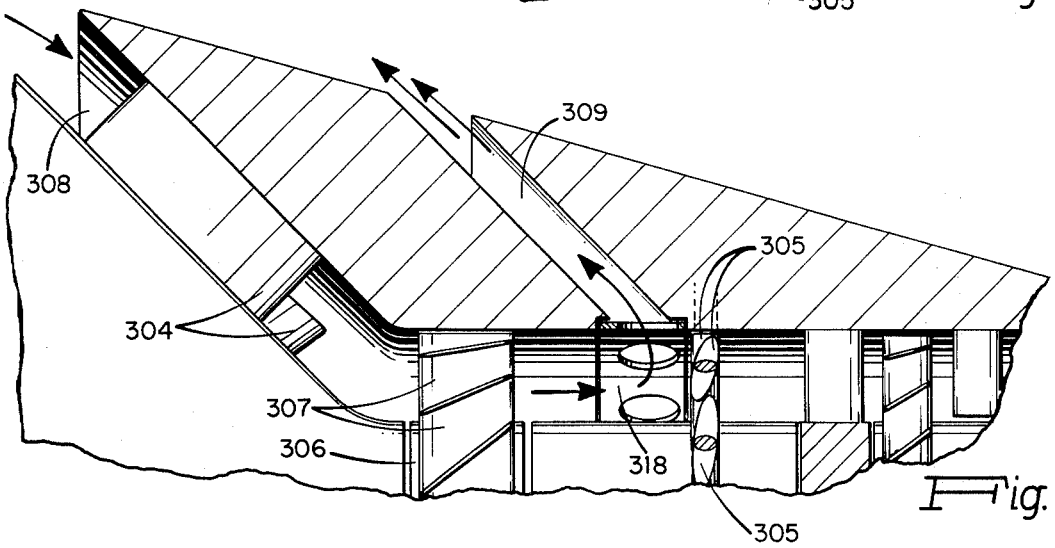

FIGS. 3 and 4 are blown-up sketches to better illustrate the thrust reversing mechanism of this invention. It will be recognized that when the reduction gear is removed and the pumpjet is directly connected to the prime mover, reversing the direction of the pump will not result in reversing the propeller rotation. This is because the guide vanes in the pump and the nozzles in the turbine do not permit effective reversal of turbine rotation. One way in which reverse thrust can be obtained is by reversible pitch propeller blades. Another possibility is including a reverse thrust water turbine stage in the propeller hub. However, for most applications, the reverse thrust can be of considerably smaller value than the forward thrust. Therefore, a rather simple reversing system can be designed by arranging closing vanes downstream of the pump anol having special reversing thrust openings in the pump and turbine casing. This arrangement, in a relatively simple way, achieves a reverse thrust of approximately 20% or more of the forward thrust. This arrangement is shown in principle in FIGS. 3 and 4. By closing the normal flow discharge path of the pump, its capacity will be reduced with a simultaneous increase in pressure, thus permitting an effective flow discharge through the reversing nozzles or channel.

In FIG. 3, movable vanes 305 are in the "open" position which results in most of the seawater pumped by pump 306 being directed into the axial turbine. Reversing channel 309, which has a cross-sectional area of about one-fifth that of the intake channel 308, is closed in this position by a perforated ring 318. In FIG. 4, movable vanes 305 are in the "closed" position. When movable vanes 305 are in the "closed" position, ring 318 is rotated to the "open" position whereby the ring perforations are aligned with corresponding perforations along the inner wall of the casing. This arrangement results in all of the seawater pumped by pump 306 being directed out through channel 309 thereby inparting a reverse thrust to the ship. This thrust reversal system makes it possible to omit the reversing turbine or the reversing gears aboard ship.

Figure 5:
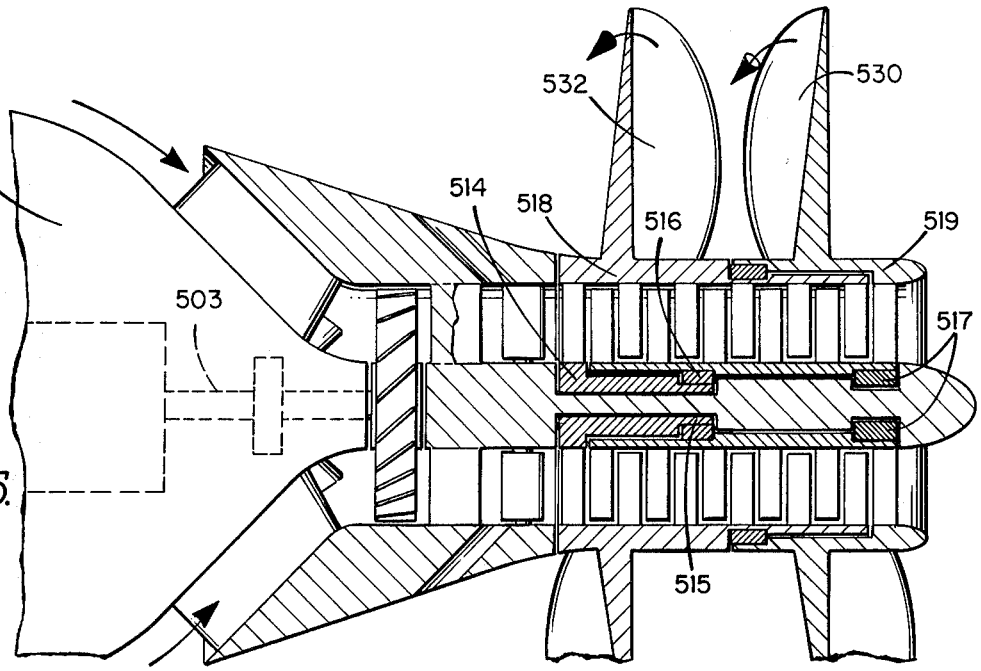
FIG. 5 illustrates the contra-rotating propeller embodiment of this invention.

FIG. 5 illustrates the contra-rotating propeller arrangement of this invention. The present invention with only a single shaft 503 passing through the ship hull is easily adapted to accomodate a contra-rotating propeller by relatively minor changes in the turbine. The turbine, instead of having a stator and a rotor, will have two rotors 518 and 519 moving in opposite directions. This arrangement necessitates a second set of bearings, 516 and 517, for the second propeller in addition to bearings 514 and 515 for supporting the first propeller. Such a system is beneficial in that it reduces the number of turbine stages and gives a simple way of achieving a contra-rotating propeller motion. The contra-rotating propellers may be of conventional design.

In a contra-rotating propeller arrangement, most of the rotational energy ordinarily lost in the ship's wake is regained. For the same thrust delivered, it has been found that there is a decrease in power requirements of about 6.5% over a single screw arrangement. Further advantages of this embodiment include improved cavitation and vibration characteristics, a decrease in propeller diameters, and overall weight and cost savings in main machinery. In a standard ship propulsion system, a contra-rotating propeller arrangement would entail complex gears in the propeller hub, coaxial shafting to the power plant, and sealing problems. When the hydrodynamic transmission of this invention is combined with the contra-rotating arrangement, however, many of the usual disadvantages are less significant or nonexistent. There are no gearing difficulties because the transmission uses no gears, instead, using a fluid between the propellers and the power plant. Coaxial shafting is not required. The typical shaft sealing problems are not present in this case. The only potential major disadvantage of the combined hydrodynamic transmission-contra-rotating arrangement seems to be the additional structure and bearings that must be considered. However, as discussed further below, this invention permits the external thrust load to be adjusted to very low values if necessary in order to accomodate the contra-rotating arrangement.

Figure 6:
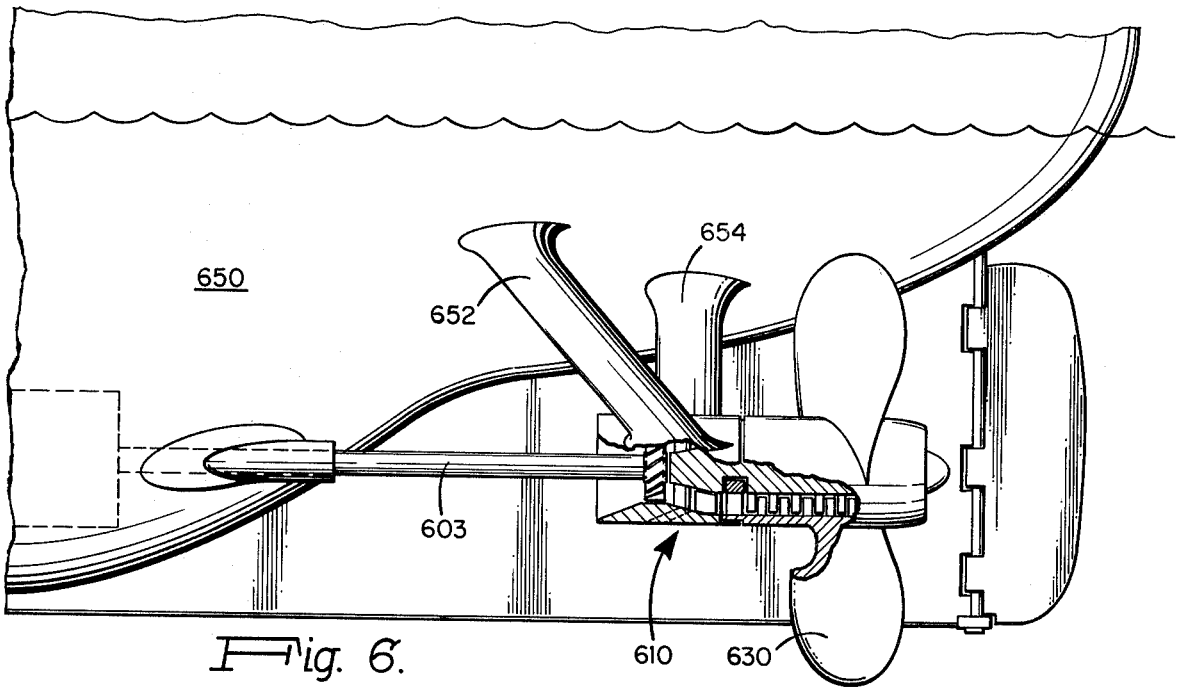
FIG. 6 shows one embodiment whereby the hydrodynamic transmission of this invention can be employed to propel a surface ship.

FIG. 6 illustrates one manner in which the hydrodynamic transmission of this invention can be utilized on a surface ship in addition to its more particular utility for submarines. In FIG. 6, the pump, turbine and propeller means are located within a single casing 610 which is fixed to the lower hull portion 650 of a surface ship by means of the power shaft 603 and support struts 652 and 654. The principal limitation in applying this invention to surface ships is that of cavitation when the propulsion system is located too close to the surface and pressure is therefore low. Accordingly, this invention is best adapted to surface ships having a draft of at least 35 feet, for example many of the new supertankers, or, alternatively, with high speed surface ships which, by forward motion, create the equivalent pressure. The surface ship also offers an opportunity to design the pump as an integral part of the ship, and in this case, only the turbine of the hydraulic transmission and the propeller become an external part of the ship. In this case, the connection between the pump inside the ship and the turbine outside the ship is a tube connecting pump and turbine. (This embodiment is not illustrated.) For a 15,000 horsepower hydraulic transmission, for example, this tube would have a diameter between two and three feet. This dimension is about the same size as existing shafts for the amount of horsepower to be transmitted.

FIG. 7 illustrates the alternative, although less preferred, embodiment of employing a centrifugal or radial turbine. To accomodate the radial discharge of seawater, it is necessary to provide hollow, open-ended propeller blades. The advantage of this arrangement is that radial turbines are well suited to the low specific speeds required for driving the propeller. On the other hand, this arrangement puts a limitation on the amount of flow which can be handled by both the turbine and the propeller, and it requires a relatively higher pressure in order to transmit the required power.

Figure 8:
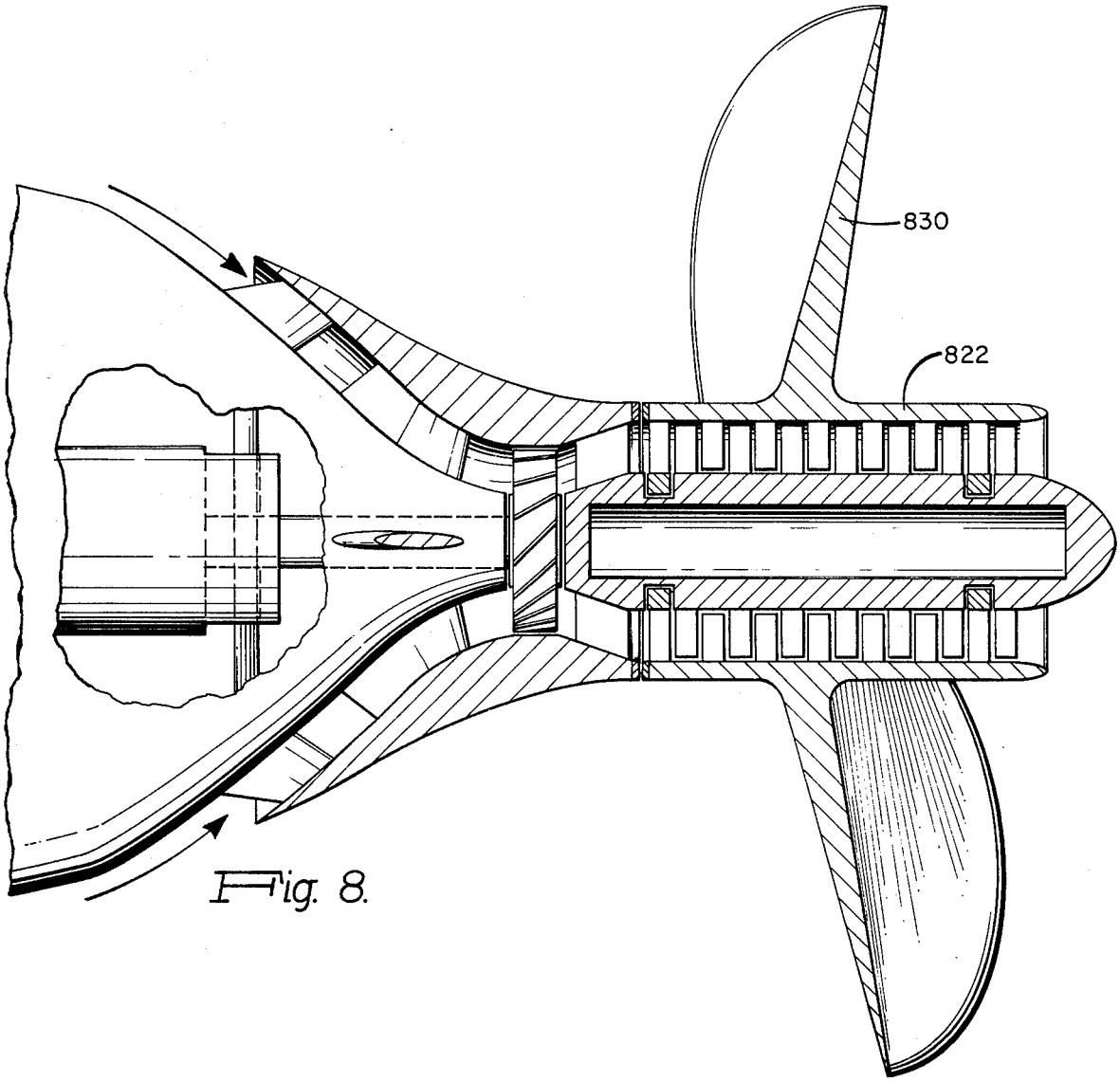
FIG. 8 shows an alternative embodiment employing an "inside-out" axial turbine which has a diameter slightly larger than the pump diameter.

FIG. 8 illustrates an alternative axial turbine embodiment in which the turbine is of the "inside-out" design having the stationary turbine blades connected to a stationary shaft and the rotating turbine blades connected to drum 822 at their outer ends. Propeller 830 is fixed to rotating drum 822. This embodiment also shows the turbine diameter being slightly larger than the pump diameter, a preferred arrangement for many applications.

It has been found that a hydrodynamic transmission employing an axial pump together with a multi-stage axial turbine results in surprisingly high efficiencies. In addition, the unit can be made small enough so that the multi-stage turbine can be built inside the hub of the propeller resulting in a very low weight.

Although a multiple-stage axial pump is feasible for application in this invention, a single stage is preferred for light weight and simplicity. The pump must also have a very high efficiency, and this requires optimization of specific speed, shaft speed, and various design parameters. The pump must operate cavitation free, and this imposes limitations on pressures, fluid velocities, blade design, pump speed, and inlet flow conditions. The pressure-flow characteristics of the pump must be matched to the turbine and the propeller characteristics. Finally, the pump and its flow inlet must be integrated into the ship configuration, and the arrangement should preferably provide for the turbine to be integral with the propeller.

In the hydrodynamic transmission of this invention, the high speed pump becomes the critical element because this unit must be designed to operate without cavitation over the entire range of the operating conditions. When using water as the transmission fluid, cavitation becomes the limiting factor regarding tip speed of both the pump impeller and the propeller. Generally, tip speeds of propellers are on the order of 100 to 200 ft./sec. with the lower values being associated with the smaller horsepower and the higher values relating to higher horsepower.

In order to permit a high and cavitation free shaft speed for the pump, which is driven directly from the power turbine, the pump should be equipped with both inlet and exit guide vanes resulting in an approximately symmetric vector diagram, thus reducing the relative water velocity over the blades to about one half of the values which would otherwise exist. Similar guide vane arrangements are commonly used in other applications. With this design, the water velocity over the blades of the pump impeller is kept within the range of values used for propellers even for large values of power transmission. Variable inlet guide vanes permit the adjustment of the pump hydraulic energy to the power turbine speed and power.

The hydrodynamic transmission of this invention also requires locating some thrust bearings outside the ship hull. Presently, with conventional propellers, the entire thrust load of the propeller is taken up inside the ship by large and heavy thrust bearings. If the transmission is designed to meet "peak power" requirements, this will substantially increase the weight and size of these bearings. The hydrodynamic transmission of this invention can alleviate thrust bearing loads because the fluid in the hydraulic transmission can transfer forces into the stationary vanes of the pump and into the nozzles of the turbine. Furthermore, the present invention permits minimization of thrust forces outside the ship by using a "reaction" turbine instead of an "impulse" turbine. In other words, depending on the degree of "reaction" in the turbine, less of the energy imparted to the seawater by the pump would be directed to the propeller blades and more would go into a direct forward thrust component as the water was ejected from the turbine outlet. Thus, this embodiment of the hydrodynamic transmission of this invention will result in a discharge velocity contributing to the overall thrust of the propulsive system. This discharge velocity, particularly if selected to have a value near the propeller discharge velocity, will also result in greatly improved velocity distribution in the wake of the entire propeller. It will, therefore, permit the use of a smaller propeller with higher efficiency than is presently in use.

A further advantage of the hydrodynamic transmission of this invention is that the suction of the pump will result in a boundary layer removal at the aft end of the ship's hull, the very place where such boundary layer removal is of greatest benefit. Consequently, the drag of the entire ship is reduced when compared to conventional propeller systems. For the case of a submarine, the pump of the hydraulic transmission operates to a substantial degree in the boundary layer and, therefore, this effect is especially dramatic. The boundary layer intake into the pump improves both the propulsive efficiency and cavitation characteristics. High propulsive efficiencies are, thus, possible since the propulsor uses the energy put into the boundary layer by skin friction with respect to an absolute frame of reference.

Another feature of this invention is that it permits the mechanical decoupling of the power plant and the propellers. This eliminates the transmission of vibration and shock to the power plant and the transmission of vibration and noise from the power plant into the propellers.

The principal advantage of the present invention, however, is that the hydrodynamic transmission as herein described results in a substantial saving of weight. Furthermore, this invention also improves weight distribution by reducing the weight at the stern portion of the ship, a particularly important feature aboard submarines. To show the general magnitude of the weight savings achieved by this invention, the following example is presented:

EXAMPLE

In the hydrodynamic transmission of this invention, the weights of the pump, water turbine, and the respective shaft and housing are added weight. The weight of the conventional reduction gear with associated foundations and propeller shaft is the weight saved. This order of magnitude weight analysis is presented in order to assess the relative merits of the hydrodynamic transmission as compared with the standard reduction gear transmission. In order to make such a comparison, each propulsion system is subdivided into a few major components. For this weight analysis, the configuration of the transmission as shown in FIG. 8 is used.

It is assumed that the propeller weight for both the hydrodynamic transmission and the gear transmission is equal. In this analysis, it is also assumed that the shaft weight of the hydrodynamic transmission from turbine to pump, including all bearings and the seal, equals the weight of the shaft of the gear transmission outside the hull. Therefore, the gear transmission is heavier by the amount of the shaft weight inside the hull which is assumed to be eighteen inches in diameter and twentyfour feet long for transmitting a predetermined amount of power.

There remains to be considered the reduction gear itself from the standard system and the casing and supports of the hydrodynamic system. The casing, due to its general shape, is approximated as a hollow cylinder of 4.0 feet outside diameter, 3.5 feet inside diameter, and a length of 5.0 feet. This results in a volume of 59.0 cubic feet. There are fourteen support members, seven before the pump impeller and seven after it, with a total volume of 6.0 cubic feet. Constructing the casing and supports of titanium alloy, the weights are calculated to be 16,300 pounds for the casing and 1700 pounds for the support amounting to a total weight of about 18,000 pounds provided the casing and support are made of titanium alloy. The weight of the reduction gear for the horsepower under consideration is estimated as 140,000 pounds.

To this weight must be added the foundations which are assumed to be between 25% and 30% of the gear weight of about 40,000 pounds. The additional weight of the shaft inside the hull is estimated as 20,000 pounds. Consequently, the order of magnitude savings are 200,000 pounds less the weight of the pump housing amounting to about 18,000 pounds. Therefore, the total savings is 182,000 pounds. However, for peak power conditions, the gear transmission will weigh in excess of 300,000 pounds while the weight of the hydrodynamic transmission remains the same so that the total weight savings for that case will be well in excess of twice the 182,000 pounds or in excess of 360,000 pounds.

The above analysis has been made on the basis of total weight in air. However, the casing of the hydrodynamic transmission is located outside the ship's hull and buoyancy becomes a factor to consider in weight analysis. The reduction gear is inside the hull and is, therefore, not itself displacing seawater. As a result, the hydrodynamic transmission has weight savings in excess of the above values. In addition, the hydrodynamic transmission is also beneficial to the total balance of the ship because the reduction of weight occurs near the aft end of the ship. Consequently, there are substantial advantages of the hydrodynamic transmission to the design of the ship as well as weight savings.

In summary, the hydrodynamic transmission of this invention has the following specific advantages over conventional propulsion systems:

a. Elimination of the reduction gear produces substantial weight savings by itself and for submarines there is also a reduction in the trimming ballast. The noise normally produced by the gear is also eliminated. Finally, the space taken up by the reduction gear is available for other equipment.

b. Inclusion of the special reversing mechanism in the new system eliminates the need for the reversing stages in the steam turbine or in the reduction gear.

c. The variable inlet guide vanes permit adjustment of the propeller speed independent of the prime mover speed and, therefore, the propeller and prime mover can operate at their respective most efficient operating conditions.

d. The propeller and the prime mover are not mechanically connected thus providing for additional safety in case the propeller should hit an object. The mechanical separation of power plant and propeller also prevents the transmission of vibration and shock to the power plant and transmission of vibration and noise from the power plant into the propeller.

e. The hydrodynamic transmission provides improved propeller efficiency and reduced propeller size due to the substantial discharge velocity from the turbine. This discharge contributes thrust. Also, the inflow of water by the suction of the pump results in a boundary layer removal from the ship's hull and thereby results in drag reduction thus reducing the power requirements.

f. The hydrodynamic transmission facilitates a fairly simple system for driving contra-rotating propellers. The hydrodynamic transmission with contra-rotating propellers has a better efficiency than existing gear systems and single propeller hydrodynamic systems.

g. The new hydrodynamic transmission operates at high efficiencies over a wide power variation range.

Having described the invention, what is claimed is:

1. Apparatus for propelling a ship through a body of water by means of the combined thrust of a water jet and a propeller driven by a hydrodynamic transmission, said apparatus comprising in combination:

a. power means within the ship;

b. an axial flow pump rotated by said power means;

c. an axial flow turbine having at least one rotatable portion, said turbine being mechanically free of said power means and disposed outside said ship adjacent its stern;

d. at least one propeller affixed to said rotatable portion of said turbine for rotation therewith; and, e. primary channel means for directing water from said body to said pump and from said pump to said turbine, the inlet end of said channel being disposed adjacent the stern portion of the ship to reduce drage;

said turbine discharging water from said pump centrally of said propeller.

2. Apparatus according to claim 1 further comprising a rotatable shaft driven by said power means and extending through the hull of the ship, said pump being affixed to said shaft for rotation therewith exteriorly of said hull intermediate the hull and said turbine, said turbine being located in the hub portion of said propeller.

3. Apparatus according to claim 1 further including means for thrust reversal, said reversal means comprising at least one auxiliary channel for water discharged from said pump, said auxiliary channel having an inlet communicating with said primary channel means downstream of said pump and an outlet for discharging water with a component of motion toward the bow of the ship, and means within said primary channel downstream of said pump for selectively diverting water from said turbine to said auxiliary channel.

4. Apparatus according to claim 1 wherein said primary channel means comprises an annular opening formed between a converging stern portion of a ship and casing means surrounding said stern portion.

5. Apparatus according to claim 4 wherein said casing means includes at least one passage extending diagonally from the inner face to the outer face of said casing means in a direction generally opposite to that of the flow of water in said primary channel means, and wherein said primary channel contains movable means for selectively diverting water from said turbine into said passage.

6. Apparatus according to claim 1 wherein said turbine has two counter-revolving portions and wherein two counter-revolving propellers are affixed one to each rotating turbine portion.

7. Apparatus according to claim 1 wherein said pump includes impeller blades and wherein fluid inlet vanes and fluid outlet vanes are disposed in said primary channel means for directing water to and from said impeller blades.

8. Apparatus according to claim 7 wherein said inlet vanes and exit vanes are arranged to provide a relative velocity of the impeller blades of about one half the circumferential velocity of said blades.

9. Apparatus according to claim 2 wherein movable vanes are disposed in said primary channel means for selectively varying the flow rate of water in said primary channel means to vary the speed of said propeller at constant aft speed of the pump.

10. Apparatus according to claim 3 wherein said turbine is located in the hub portion of said propeller, said pump includes impeller blades, fluid inlet and outlet vanes are disposed in said primary channel for directing water to and from said impeller vanes, and wherein at least one set of said inlet and outlet vanes are movable to control the water flow rate to said turbine.

11. Apparatus according to claim 2 wherein said turbine has rotatable blades and said propeller is supported by thrust bearings, said turbine blades being arranged to provide a reaction force reducing the force on the propeller thrust bearings, the force on the propeller thrust bearings during propeller rotation being less than the thrust force of said propeller.

* * * * *